US006554395B2

(12) United States Patent
Cole et al.

(10) Patent No.: US 6,554,395 B2
(45) Date of Patent: Apr. 29, 2003

(54) PRINT HEAD SERVO AND VELOCITY CONTROLLER WITH NON-LINEAR COMPENSATION

(75) Inventors: Charles P. Cole, Richardson, TX (US); Stephen J. Fedigan, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/141,246

(22) Filed: May 8, 2002

(65) Prior Publication Data

US 2002/0196308 A1 Dec. 26, 2002

Related U.S. Application Data

(60) Provisional application No. 60/296,834, filed on Jun. 8, 2001.

(51) Int. Cl.[7] ..... B41J 23/00
(52) U.S. Cl. ..... 347/37; 400/322
(58) Field of Search ..... 347/5, 19, 37; 400/279, 283, 319, 322, 355; 318/696, 685

(56) References Cited

U.S. PATENT DOCUMENTS 4,270,868 A * 6/1981 Morgan et al. ..... 400/320
4,459,675 A * 7/1984 Bateson et al. ..... 400/322
4,463,435 A * 7/1984 Cavill ..... 400/322
5,748,206 A * 5/1998 Yamane ..... 347/37

* cited by examiner

*Primary Examiner*—Thinh Nguyen
*Assistant Examiner*—Julian D. Huffman
(74) *Attorney, Agent, or Firm*—Robert D. Marshall, Jr.; W. James Brady, III; Frederick J. Telecky, Jr.

(57) ABSTRACT

A print head motor control system uses a desired function of print head position versus time and a measured print head position to form an error signal. The print head controller forms a motor drive signal from the sum of a first term corresponding to the square root of the absolute value of the error signal and a second term corresponding to a dead band signal having a predetermined slope if said error signal exceeds a predetermined value. The desired function of print head position versus time may be formed by double integrating a desired function of print head acceleration versus time. The print head motor control preferably also includes a velocity loop subtracting a print head velocity estimated from the measured print head position from the sum. The print head motor control is preferably implemented using a microprocessor.

15 Claims, 5 Drawing Sheets

PRINT HEAD SERVO AND VELOCITY CONTROLLER WITH NON-LINEAR COMPENSATION

This application claims priority under 35 USC §119(e) (1) of Provisional Application No. 60/296,834, filed Jun. 8, 2001.

TECHNICAL FIELD OF THE INVENTION

The technical field of this invention is servo control and more particularly control of print head position and velocity during printing.

BACKGROUND OF THE INVENTION

Ink jet printing requires careful control of the print head speed during a printing pass across the paper. It is generally desirable to have a constant print head velocity during printing. This involves four phases of print head drive control. In a first phase the print head is held in position beyond the beginning of the print swath. In a second phase the print head is accelerated up to the desired print velocity. During the third phase the velocity is regulated to be constant during actual printing. In the fourth phase after passing the end of the print swath, the print head is decelerated to a stop. In order to increase the printer throughput, it is common to limit the print head carriage travel to less than the entire page width for lines that do not require printing across the entire page width. This could occur for text at the end of a paragraph. Following this deceleration, the controller returns to the first phase where it holds print head position.

FIG. 1 illustrates the print head control in accordance with the prior art. Print head control system 100 includes printer engine 110, interface circuits 120 and microprocessor controller 130. Printer engine 110 includes print head 101, drive motor 102, drive belt 103, pulley 104 and linear position encoder strip 105. Print head 101 includes the mechanisms for producing ink droplets for application to the page being printed. These mechanisms are conventional, not a part of this invention and will not be described in detail. Drive motor 102 receives drive signals $v_{M1}$ and $v_{M2}$ and moves belt 103 accordingly. Belt 103 is continuous and wraps around pulley 104. Print head 101 is attached to belt 103 and moves when belt 103 moves. Pulses from linear position encoder strip 105 are detected by a quadrature pulse encoder which generates two signals CH_A and CH_B which are 90° out of phase. This position sensing system is known in the art, is not a part of this invention and will not be described in further detail.

Interface circuits 120 include quadrature pulse encoder (QEP) decoder/counter 121, digital to analog converter 123 and motor drive circuit 125. Quadrature pulse encoder decoder/counter 121 receives the two signals CH_A and CH_B and produces a counter value x indicative of the position of print head 101. The relative phase of the two signals CH_A and CH_B provide an indication of the direction of motion and the number of pulses indicates that amount of travel. Special purpose circuits to embody quadrature pulse encoder decoder/counter 121 are known in the art. A Hewlett-Packard HP-2020 decoder integrated circuit is widely used for this purpose. Digital to analog converter (DAC) 123 receives a digital current command signal $i_{cmd}$ from microprocessor controller 130 and converts this into an analog signal driving motor drive circuit 125. Digital to analog converter 123 and motor drive circuit 125 operate to supply electrical power to motor 102 to achieve the desired motion of print head 101. Motor drive circuit 125 is constructed to be compatible with motor 102 to effect control of the position and velocity of print head 101.

Microprocessor controller 130 includes command generator (Cmd Gen) 131, summing junction 132, proportional-integral-derivative (PID) controller 133, velocity estimator 134 and mode switch 135. The name microprocessor controller implies that this function is embodied by a programmed microprocessor. Though illustrated as separate components, it is known in the art to embody the control illustrated in FIG. 1 via discrete equations performed by a programmed microprocessor. Microprocessor controller 130 receives the print head position signal x and produces a digital current command signal $i_{cmd}$ for control of the position and velocity of print head 101. Command generator 131 generates a command signal r corresponding to the desired print head movement. This will be further described below. Summing junction 132 forms an error signal e between this command signal r and a feedback signal from QEP decoder/counter 121. This error signal e is subject to a proportional-integral-derivative controller 133. Proportional-integral-derivative control is well known in the art. Proportional-integral-derivative controller 133 calculates the sum of three terms from the error signal. A proportional term is proportional to the error signal e. An integral term is a time sum of the error signal e. Lastly, a derivative term is the rate of change of the error signal e. The sum of these three terms is the current command signal $i_{cmd}$.

Microprocessor controller 130 operates in two modes as selected by mode switch 135. In a velocity mode velocity estimator 134 forms a velocity estimate $v_{est}$ of the print head 101 velocity from the position signal x. Summing junction 132 subtracts this velocity estimate $v_{est}$ as selected by mode switch 134 from the command signal r. In a position mode, mode switch 135 selects the position signal x. Summing junction 132 subtracts the position signal x from the command signal r.

FIG. 2 illustrated the typical operation of prior art print head control system 100. The Y-axis of FIG. 2*a* is r, from command generator 131. The Y-axis of FIG. 2*b* is x, the print head position from QEP decoder/counter 121. FIGS. 2*a* and 2*b* have aligned X-axes in time t. During time interval $t_1$ microprocessor controller 130 is in position mode and mode switch 135 selects position signal x from QEP decoder/counter 121. Command generator 131 generates command signal r corresponding to the desired print head position. For the sake of this example, assume that the desired position is near the leftmost limit of print head 101 travel beyond the printable portion of the page. Proportional-integral-derivative controller 133 produces a current command signal $i_{cmd}$ which results in print head 101 reaching the commanded position. At that time the error signal e is zero and no further movement takes place.

During time interval $t_2$ microprocessor controller 130 is in an acceleration phase. Mode switch 135 selects the velocity estimate $v_{est}$ from velocity estimator 134. Command generator 131 generates the command signal r corresponding to the desired velocity. As illustrated in FIG. 2*a*, the command signal r increases during time interval $t_2$ corresponding to the desired acceleration. FIG. 2*b* shows a corresponding change in the position signal x. The rate of acceleration commanded during time interval $t_2$ is selected to reach the desired velocity for printing when the edge of the printable area is reached.

During time interval $t_3$ the printing takes place. Microprocessor controller 131 is in the velocity mode and commands a constant velocity. Proportional-integral-derivative controller 133 produces a current command signal $i_{cmd}$ to achieve this desired constant velocity. FIG. 2*b* illustrates linear change in the position signal x with respect to time.

During time interval $t_4$ microprocessor controller 130 is in a deceleration phase. Command generator 131 generates a command signal r corresponding to decreasing velocity, eventually reaching a zero velocity. In this example, this deceleration phase stops print head 101 at the end of the current print line. This is not necessarily the end of the printable part of the page. FIG. 2*b* shows slowing of the rate of change of the position signal x to zero at the end of time interval $t_4$.

Time interval $t_5$ is another hold position interval. Mode switch 135 selects the position signal x and command generator 131 produces the command signal r corresponding to the desires hold position. In this example the desired position during time interval $t_5$ is at the far right, the opposite end of the range of travel of print head 101. Print head 101 is now in position for another printing pass in the opposite direction.

Another commanded print head movement takes place during time intervals $t_6$, $t_7$ and $t_8$. For time interval $t_6$ microprocessor controller 130 is in velocity mode and mode switch 135 selects the velocity estimate $v_{est}$. Command generator 131 commands a linearly increasing velocity resulting in acceleration. The sign of the voltage command is negative indicating travel in the opposite direction than during time intervals $t_2$, $t_3$ and $t_4$. During time interval $t_7$ command generator 131 commands a constant return velocity for the printing pass. During time interval $t_8$ command generator 131 commands a linearly decreasing velocity resulting in deceleration of print head 101. Finally, microprocessor controller 130 switches to position mode via mode switch 135 and commands a constant position during time interval $t_9$.

Despite the wide use of the print controller technique of FIG. 1, there are numerous problems with this technique. Storing the desired velocity profile may require considerable memory. In the velocity mode the integrator term of the PID controller automatically calculates the steady state current required to achieve the desired slew rate. However, the PID controller requires time for the integrator term to settle to a steady state. This time must be added to the time required to achieve the desired printing velocity. As a consequence, each printing pass requires more time than necessary. This extra time decreased the achieved page print rate. The page print rate is one of the key user careabout with a printer. Another problem occurs with the position mode. In many printers, particularly those which have been used extensively, there is considerable static friction in the print head movement. If the print head does not stop at the desired location, then the integrator term of the PID controller will eventually generate a large enough drive to move the print head toward the desired location. However, once moving the friction is generally reduced from the high static friction value. The high integrator drive could fail to react quickly enough to avoid overshooting the desired location. Thus the print head would stop a another location different than the desired location. In some instances this causes continual hunting for the desired location with each step overshooting the target. Lastly, the command signal often differs markedly when switching between the velocity and position modes. This may generate large switching transients which can damage the system.

SUMMARY OF THE INVENTION

A print head motor control uses a desired function of print head position versus time and a measured print head position to form an error signal. The print head controller forms a motor drive from the sum of a first term corresponding to the square root of the absolute value of the error signal and a second term corresponding to a dead band signal having a predetermined slope if said error signal exceeds a predetermined value.

The first term preferably uses the following formula:

$$v_1=\sqrt{|e|}\,\mathrm{sign}(e)$$

where: $v_1$ is the desired first term; e is the error signal; |e| is the absolute value of the error signal; and sign(e) is the sign of the error signal e, 1 if e is greater than zero and −1 if e is less than zero. The second term preferably uses the following formula:

$$v_2=\max(0,\ |e|-K_{dz})\,\mathrm{sign}(e)$$

where: $v_2$ is the desired second term; max( ) is the maximum function returning the maximum of its arguments; and $K_{dz}$ is a predetermined constant indicative of the size of the dead zone.

The desired function of print head position versus time may be formed by double integrating a desired function of print head acceleration versus time. This desired function of print head acceleration preferably includes: a stored acceleration value and a corresponding predetermined acceleration time for an acceleration segment; a calculated time for a constant velocity segment having zero acceleration; a stored deceleration value and a corresponding predetermined deceleration time for a deceleration segment; and a calculated time for a dwell segment having zero acceleration and zero velocity.

The print head motor control preferably also includes a velocity loop. The print head velocity is estimated from the measured print head position. This estimated print head velocity is subtracted from the sum 235. The resulting difference is scaled to form the motor drive. The velocity estimate preferably includes a low pass filter.

The print head motor control is preferably implemented using a microprocessor.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
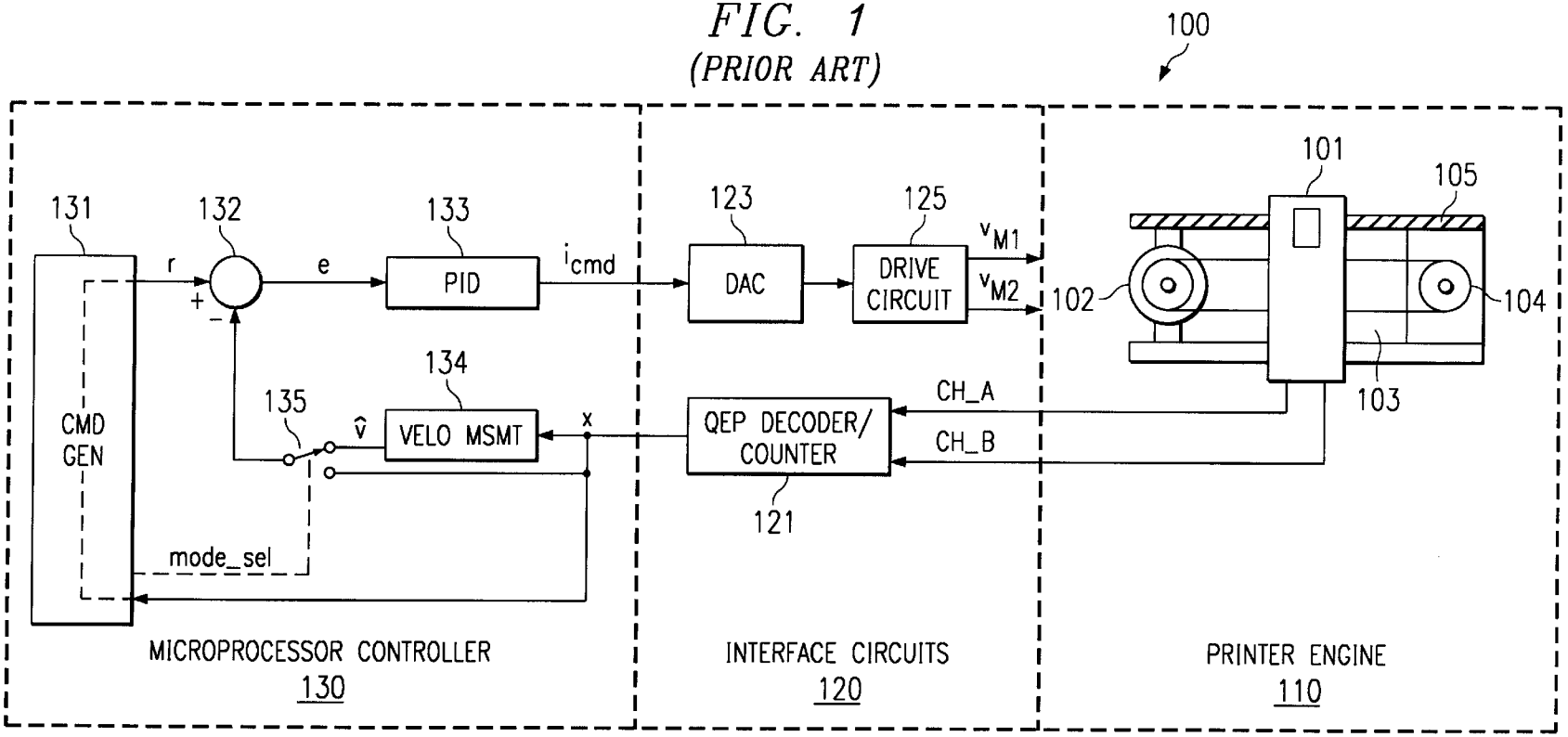
FIG. 1 (PRIOR ART)
FIG. 1 illustrates the print head control in accordance with one example of the prior art.
Figure 2A:
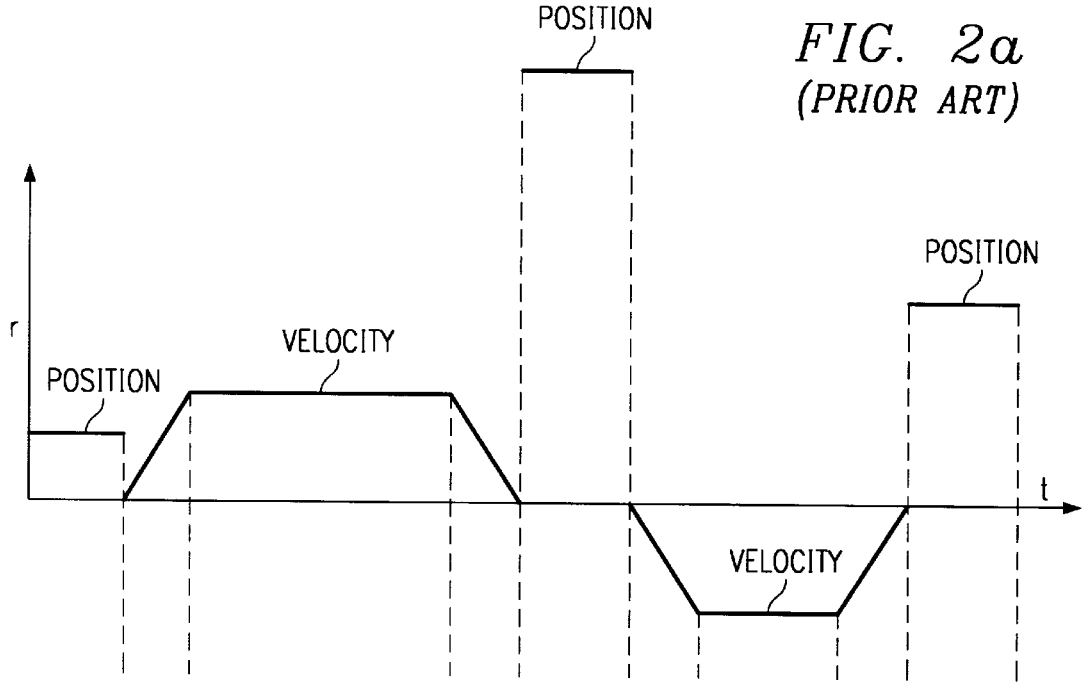
FIG. 2a (PRIOR ART)
FIG. 2 illustrated the typical operation of prior art print head control system illustrated in FIG. 1.
Figure 2B:
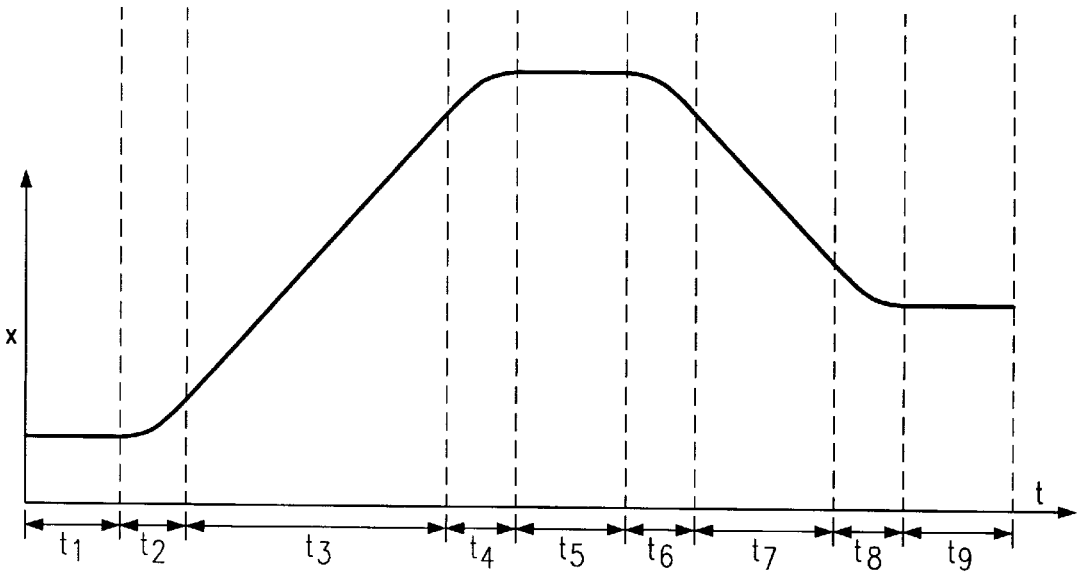
FIG. 2b (PRIOR ART)
Figure 3:
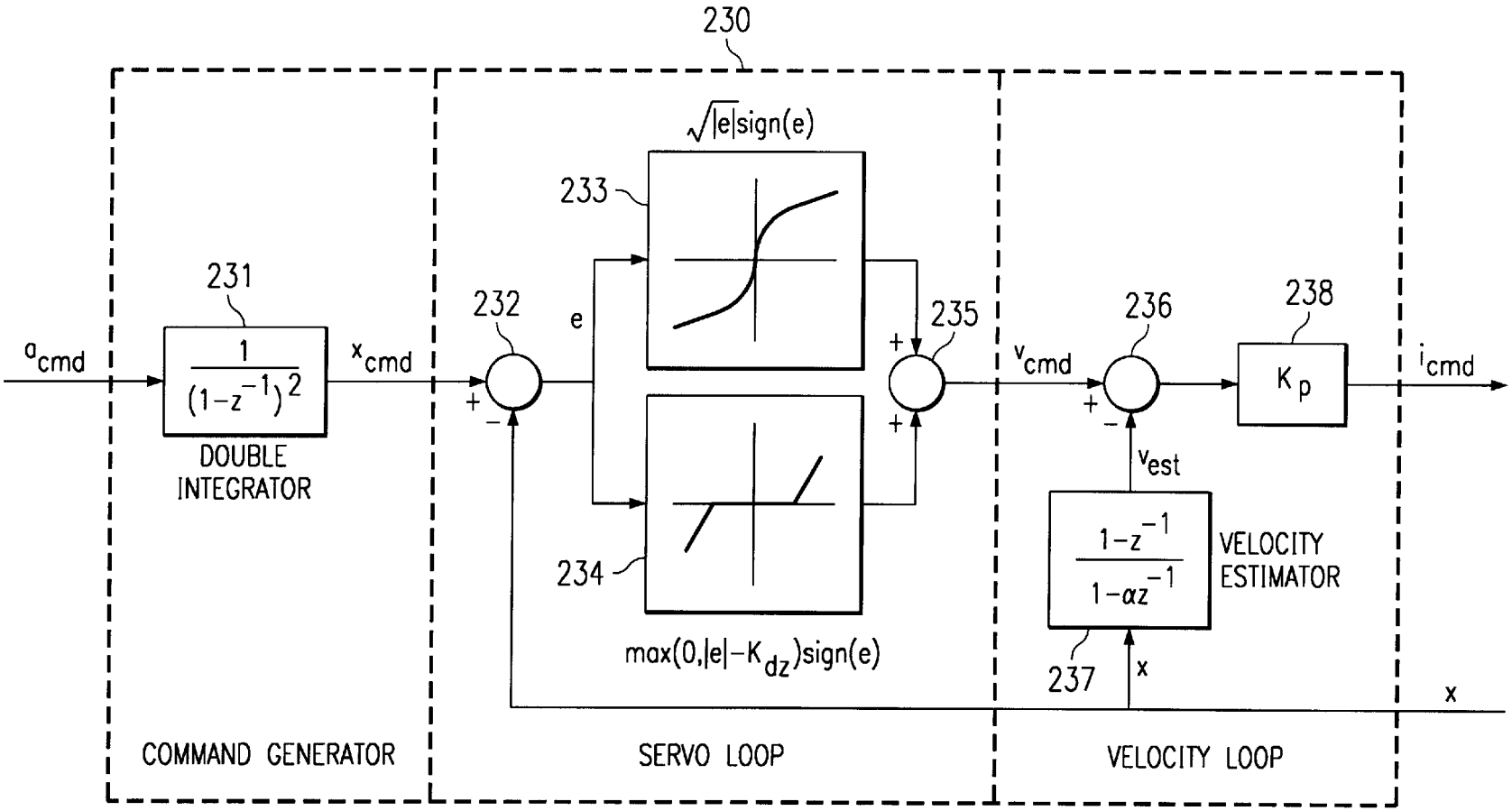
FIG. 3 illustrates a microprocessor controller implementing the print controller of this invention.

FIG. 3 illustrates microprocessor controller 230 of this invention. Microprocessor controller 230 substitutes for microprocessor controller 130 in FIG. 1. Microprocessor controller 230 receives position signal x from QEP decoder/counter 121 and generates current command signal $i_{cmd}$ for supply to digital to analog converter 123.

In accordance with the present invention, the command profile is stored as an acceleration profile. This is shown in tabular form in Table 1.

TABLE 1

| Segment | Acceleration | Samples |
|---|---|---|
| acceleration | a_accel | n_accel |
| constant velocity | 0 | n_cv |
| deceleration | a_decel | n_decel |
| dwell | 0 | n_dwell |

Note that this technique requires the storage of very little data. The magnitude of the acceleration a_accel and of the deceleration a_decel together with their respective durations n_accel and n_decel are preferably selected after consideration of the mass of print head 101 and the torque capacity of motor 102. These quantities can be fixed for any particular printer. The duration of the constant velocity n_cv is preferably selected based upon the print width for that particular print pass. Thus this quantity may be variable down the page. The duration of the dwell n_dwell is also preferably variable to accommodate variable amounts of data processing between print passes.

The desired position command is obtained by double integration in double integrator 231. Double integrator 231 preferably implements the following difference equations:

$$v_n = v_{n-1} + a_n$$

$$x_n = x_{n-1} + v_n$$

where: $a_n$ is the current time sample acceleration; $v_n$ is the current time sample velocity; $v_{n-1}$ is the velocity of the prior time sample; $x_n$ is the current time sample position; and $x_{n-1}$ is the position of the prior time sample. Note that rounding problems in this double integration may be avoided using acceleration amounts a_accel and a_decel which are whole integers.

Figure 4:
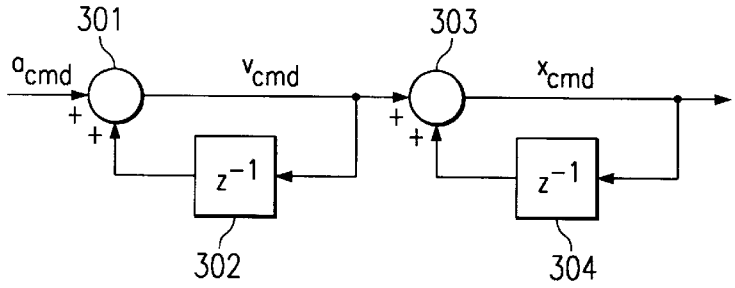
FIG. 4 schematically illustrates the double integration process shown in FIG. 3.

FIG. 4 illustrates this double integration process schematically. The acceleration command signal $a_{cmd}$ is supplied to one input of summing junction 301. A second input of summing junction 301 receives the output of summing junction 301 (called the velocity command signal $v_{cmd}$) from one sample delay 302. The velocity command signal $v_{cmd}$ is supplied to one input of summing junction 303. A second input of summing junction 303 receives the output of summing junction 303 (called the position command signal $x_{cmd}$) from one sample delay 304. The output of summing junction 303 is the position command signal $x_{cmd}$.

Figure 5A:
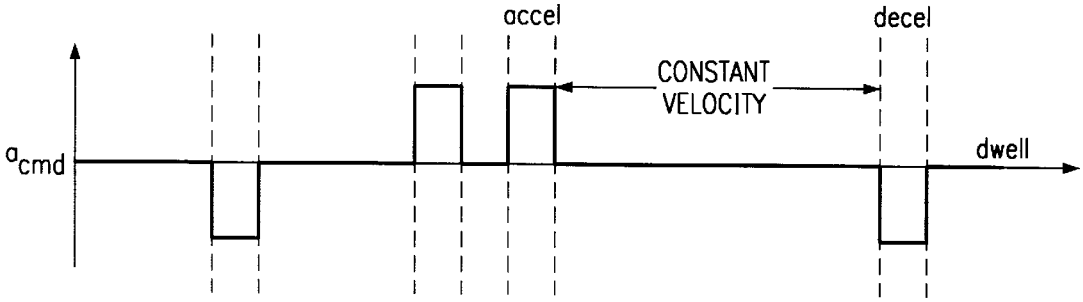
FIG. 5 illustrates the acceleration profile of this invention together with the resulting velocity profile and position profile.
Figure 5B:
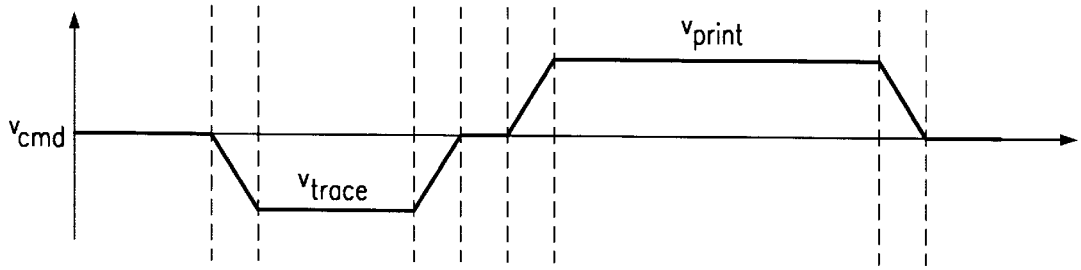
Figure 5C:
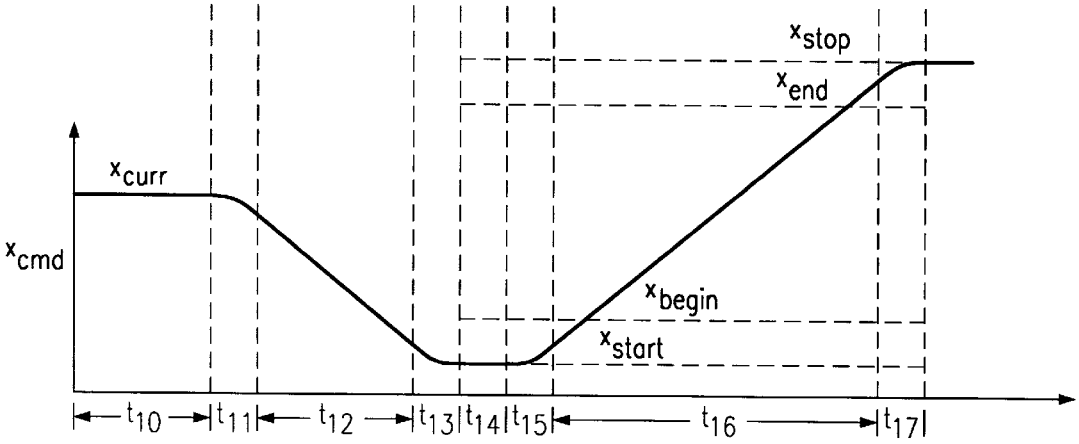

FIG. 5 illustrates the acceleration profile together with the resulting velocity profile and position profile. FIG. 5*a* illustrates the acceleration profile. FIG. 5*b* illustrates the resultant velocity profile. FIG. 5*c* illustrates the resultant position profile. During time interval $t_{10}$ print head 101 is stationary at position $x_{curr}$. In this example assume that print head 101 is at the far end of travel in the normal direction, that is at the far right of its travel. Time interval $t_{11}$ is an acceleration segment, the sign of the accelerating being negative because print head 101 is retracing the normal direction of travel. Time interval $t_{12}$ is a constant velocity segment. The acceleration is zero but the velocity remains $v_{trace}$. Time interval $t_{13}$ is a deceleration segment where print head 101 is stopped at position $x_{start}$. Time interval $t_{13}$ is a dwell time where print heat 101 remains at position $x_{start}$. Time interval $t_5$ is another acceleration segment. In this segment the direction of motion makes the acceleration positive. Time interval $t_{16}$ is a constant velocity segment. During time interval $t_{16}$ print head has velocity $v_{print}$. The acceleration is selected to achieve this printing velocity $v_{print}$ during travel between position $x_{begin}$, the beginning of the print range, and position $x_{end}$, the end of the print range. Time interval $t_{17}$ is a deceleration segment. The deceleration is selected to stop print head 101 at position $x_{stop}$.

The servo loop includes summing junction 232, compensators 233 and 234 and summing 235. Summing junction 232 forms error signal e by subtracting the position signal x from the position command signal $x_{cmd}$. Compensators 233 and 234 operate in parallel and serve as the heart of the control system. FIG. 3 illustrates respective graphs of these two functions. Summing junction 235 sums the outputs of compensators 233 and 234. Compensator 233 preferably implements the following equation:

$$v_i = \sqrt{|e|}\,\mathrm{sign}(e)$$

Thus compensator 233 forms the square root of the absolute value of error signal e having the same sign as error signal e. Compensator 233 had a large slope near zero error and a decreasing slope for increasing error. Compensator 234 preferably implements the following equation:

$$v_{cmd} = \max(0, |e| - K_{dz})\,\mathrm{sign}\,(e)$$

This equation forms two sloping lines offset with a dead zone of $K_{dz}$. Thus compensator 234 has no effect when the error signal e is small.

The velocity loop includes summing junction 236, velocity estimator 237 and gain element 238. Summing junction 236 forms the difference between the velocity command signal $v_{cmd}$ from summing junction 235 and the velocity estimate $v_{est}$ from velocity estimator 237. The output of summing junction 236 is supplied to gain element 238, which provides a gain or scaling factor of $K_p$. The output of gain element 238 is the current command signal $i_{cmd}$. Velocity estimator 237 preferably implements the following equations:

$$v_{inst} = x_n - x_{n-1}$$

$$\underline{v}_n = r\underline{v}_{n-1} + (1-r)v_{inst}$$

These equations correspond to differentiation of the position signal x followed by a low pass filter function. The low pass filter smooths the differential output.

Figure 6:
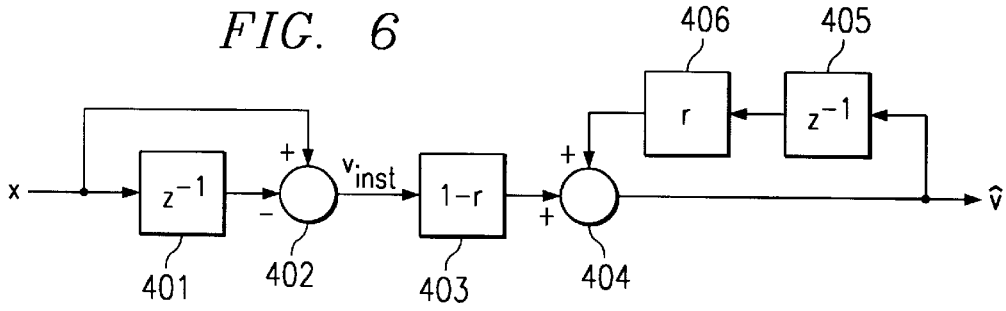
FIG. 6 schematically illustrates the velocity estimation process.

FIG. 6 illustrates this velocity estimation process schematically. The input position signal x is supplied to one sample delay element 401 and summing junction 402. The other input of summing junction 402 receives the output of one sample delay element 401. Summing junction 402 subtracts the delayed position signal from the current position signal, thereby producing an instantaneous velocity signal $v_{int}$. The filter includes gain element 403 which receives instantaneous velocity signal $v_{inst}$ and supplies one input of summing junction 404. The other input of summing junction 404 receives its input from one sample output delay element 405 and gain element 406. The output of summing junction 404 is the desired velocity estimate signal $v_{est}$.

Figure 7:
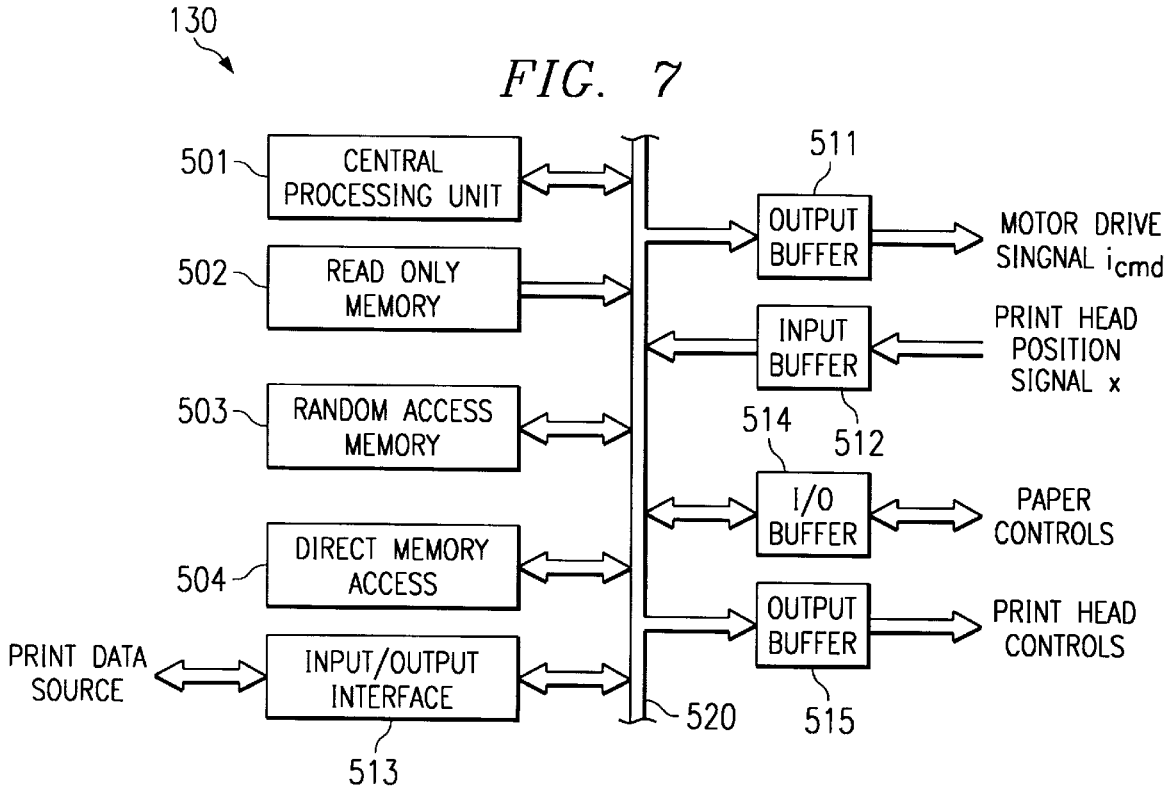
FIG. 7 illustrates an example of microprocessor hardware used to embody microprocessor controller of this invention.

FIG. 7 illustrates an example of microprocessor hardware used to embody microprocessor controller 130. Microprocessor controller 130 includes central processing unit 501, read only memory 502, random access memory 503, direct memory access unit 504, output buffer 511, input buffer 512, input/output interface 513, I/O buffers 514 and output buffer 515, all connected to a central bus 520. In a practical embodiment, microprocessor controller 130 controls other functions of the printer as known in the prior art in addition to the print head position and velocity control of this invention. Central processing unit 501 operates on stored instructions to perform the control processes described above. Read only memory 502 includes at least the instructions for central processing unit 501 for initializing operations. Read only memory 502 preferably includes all the instructions for printer control including the processed described above. Random access memory 503 stores temporary data used by central processing unit 501. This temporary data includes page data before printing, the print head position signal x, intermediate data computed in accordance with the print position control of this invention, the computed drive command signal $i_{cmd}$ and other input/output and intermediate quantities. Direct memory access unit 504 operates under control of central processing unit 501 to move data among various parts of FIG. 7 via central bus 520 without requiring detail control by central processing unit 501. Direct memory access unit 504 is most useful in transferring received print data from input/output interface 513 to random access memory 503 and transferring output data from random access memory 503 to output buffer 515. Output buffer 511 supplies the drive command signal $i_{cmd}$ to digital to analog converter 123. Input buffer 512 receives position signal x from QEP decoder/counter 121. Microprocessor controller 130 preferably controls other aspects of the printer. Input/output interface 513 provides bi-directional communication with the print data source. A personal computer is a typical print data source. I/O buffers 514 provides bi-directional communication of paper controls. As examples only, I/O buffers 514 must transmit paper pickup, paper advance and paper release signals to the paper handling mechanism. Examples of inputs include paper out and paper jam indications. These latter signals are generally transmitted to the print data source to indicate the need for remedial action. Output buffer 515 supplies the print head controls for ink jet production in synchronism with the print head motion controlled according to the description above.

This modified microprocessor controller provides several advantages. The command signals are advantageously stored as an acceleration profile. As shown in Table 1, this requires storage of little data for complete specification of the desired print head motion. The square root term (compensator 233) provides high stiffness at low error values. This permits accurate positioning at slow speeds and near the final position. This also avoids the hunting problem often observed in prior art proportional-integral-derivative controllers because the controller output does not depend upon previous controller outputs. Because this positioning does not depend upon an integrator to generate a high enough drive to overcome possible static friction, the cause of hunting is eliminated. The dead band function of compensator 234 provides large slew at large error. This reduces the rise time during acceleration and deceleration. This also automatically turns off the extra compensation near zero error without requiring a mode change. This reduces the possibility of transients. The absence of an integrator also reduces the settling time in the slew mode.

What is claimed is:

1. A method of print head motor control comprising the steps of:

forming a desired function of print head position versus time;

measuring the print head position;

forming an error signal from a difference of a current desired print head position and a measured print head position; and forming a motor drive signal from the sum of a first term corresponding to the square root of the absolute value of the error signal and a second term corresponding to a dead band signal having a predetermined slope if said error signal exceeds a predetermined value.

2. The method of claim 1, wherein:

said step of forming the motor drive signal calculates said first term according to:

$$v_1=\sqrt{|e|}\,\mathrm{sign}(e)$$

where: $v_1$ is the desired first term; e is the error signal; |e| is the absolute value of the error signal; and sign(e) is the sign of the error signal e, 1 if e is greater than zero and −1 if e is less than zero, and said step of forming the motor drive signal calculates said second term according to:

$$v_2=\max(0,\ |e|-K_{dz})\,\mathrm{sign}(e)$$

where: $v_2$ is the desired second term; max( ) is the maximum function returning the maximum of its arguments; and $K_{dz}$ is a predetermined constant indicative of the size of the dead zone.

3. The method of claim 1, wherein:

said step of forming a desired function of print head position versus time includes forming a desired function of print head acceleration versus time, and double integrating said desired print head acceleration to form said desired print head position.

4. The method of claim 3, wherein:

said step of forming a desired function of print head acceleration versus time includes storing an acceleration value and a corresponding predetermined acceleration time for an acceleration segment, determining a time for a constant velocity segment having zero acceleration, storing a deceleration value and a corresponding predetermined deceleration time for a deceleration segment, and determining a time for a dwell segment having zero acceleration and zero velocity.

5. The method of claim 1, further comprising the step of:

estimating print head velocity from the measured print head position; and said step of forming a motor drive signal includes subtracting the estimated print head velocity from the sum.

6. The method of claim 5, wherein:

said step of estimating the print head velocity includes subtracting a prior measured print head position from a current measured print head position.

7. The method of claim 6, wherein:

said step of estimating the print head velocity further includes low pass filtering the difference of the sum and the estimated print head velocity.

8. A printer comprising:

a print head movably mounted to a carriage for scanning across a page to be printed;

a drive motor coupled to said print head bidirectionally driving said print head across said page to be printed;

a position sensor mounted on said print head generating a position signal indicative of a position of said print head within said page to be printed;

a print head controller connected to said drive motor and receiving said position signal from said position signal, said print head controller operable to form a desired function of print head position versus time, form an error signal from a difference of a current desired print head position and said position signal, and supply a motor drive signal to said drive motor from the sum of a first term corresponding to the square root of the absolute value of said error signal and a second term corresponding to a dead band signal having a predetermined slope if said error signal exceeds a predetermined value.

9. The printer of claim 8, wherein:

said print head controller calculates said first term according to:

$$v_i=\sqrt{|e|}\,\mathrm{sign}(e)$$

where: $v_i$ is the desired first term; e is the error signal; |e| is the absolute value of the error signal; and sign(e) is the sign of the error signal e, 1 if e is greater than zero and −1 if e is less than zero; and said print head controller calculates said second term according to:

$$v_1=\max(0,\ |e|-K_{dz})\mathrm{sign}(e)$$

where: $v_2$ is the desired second term; max( ) is the maximum function returning the maximum of its arguments; and $K_{dz}$ is a predetermined constant indicative of the size of the dead zone.

10. The printer of claim 8, wherein:

said print head controller forms said desired function of print head position versus time including forming a desired function of print head acceleration versus time, and double integrating said desired print head acceleration to form said desired print head position.

11. The printer of claim 10, wherein:

said print head controller forms said desired function of print head acceleration versus time including storing an acceleration value and a corresponding predetermined acceleration time for an acceleration segment, determining a time for a constant velocity segment having zero acceleration, storing a deceleration value and a corresponding predetermined deceleration time for a deceleration segment, and determining a time for a dwell segment having zero acceleration and zero velocity.

12. The printer of claim 8, wherein:

said print head controller further estimates print head velocity from the measured print head position, and forms said motor drive signal including subtracting the estimated print head velocity from the sum.

13. The printer of claim 12, wherein:

said print head controller further estimates the print head velocity includes subtracting a prior measured print head position from a current measured print head position.

14. The printer of claim 13, wherein:

said print head controller further low pass filters the difference of the sum and the estimated print head velocity.

15. The printer of claim 8, wherein:

said print head controller includes a microprocessor.

* * * * *